US005551517A

United States Patent [19]

Arsenault et al.

[11] Patent Number: 5,551,517

[45] Date of Patent: Sep. 3, 1996

[54] AUTOMATIC FIRE EXTINGUISHING DISCHARGE VALVE

[76] Inventors: Joseph Arsenault, 92 Chesnut St., Saugus, Mass. 01906; James Analetto, 27 Line Rd., Reading, Mass. 01867

[21] Appl. No.: 523,180

[22] Filed: Sep. 5, 1995

[51] Int. Cl.[6] ..... A62C 35/02

[52] U.S. Cl. ..... 169/57; 169/62; 169/26; 169/71

[58] Field of Search ..... 169/62, 26, 19, 169/57, 30, 71, 89, 60

[56] References Cited

U.S. PATENT DOCUMENTS

| | | | |
|---|---|---|---|
| 3,547,201 | 12/1970 | Balmes | 169/71 |
| 3,642,071 | 2/1972 | Utesch | 169/19 |
| 3,649,786 | 3/1972 | Mauron . | |
| 3,708,194 | 1/1973 | Amit . | |
| 3,788,666 | 1/1974 | Kramer et al. . | |
| 3,860,073 | 1/1975 | Willms . | |
| 3,915,236 | 10/1975 | Stichling | 169/26 |
| 3,961,669 | 6/1976 | Kaneko | 169/62 |
| 4,011,911 | 3/1977 | Gow . | |
| 4,633,967 | 1/1987 | Kranz . | |
| 4,655,087 | 4/1987 | Roznieck i . | |
| 5,040,610 | 8/1991 | Blanchong . | |
| 5,119,878 | 6/1992 | Lee | 169/62 |

FOREIGN PATENT DOCUMENTS

| | | | |
|---|---|---|---|
| 811518 | 4/1937 | France | 169/26 |

*Primary Examiner*—Gary C. Hoge

*Attorney, Agent, or Firm*—Scott B. Garrison; Gary E. Lambert

[57] ABSTRACT

An automatic fire extinguishing discharge valve capable of attachment to a fire extinguisher thereby enabling automatic discharge of extinguishing medium upon sufficient impact or temperature rise. The automatic feature is controlled by maintaining a temperature sensitive trigger mechanism of a predesigned mass in opposition to a spring force attempting to drive a puncturing mechanism into the fire extinguisher. So long as the trigger mechanism remains in place the fire extinguisher will remain at the ready position and will not discharge the suppressant.

3 Claims, 1 Drawing Sheet

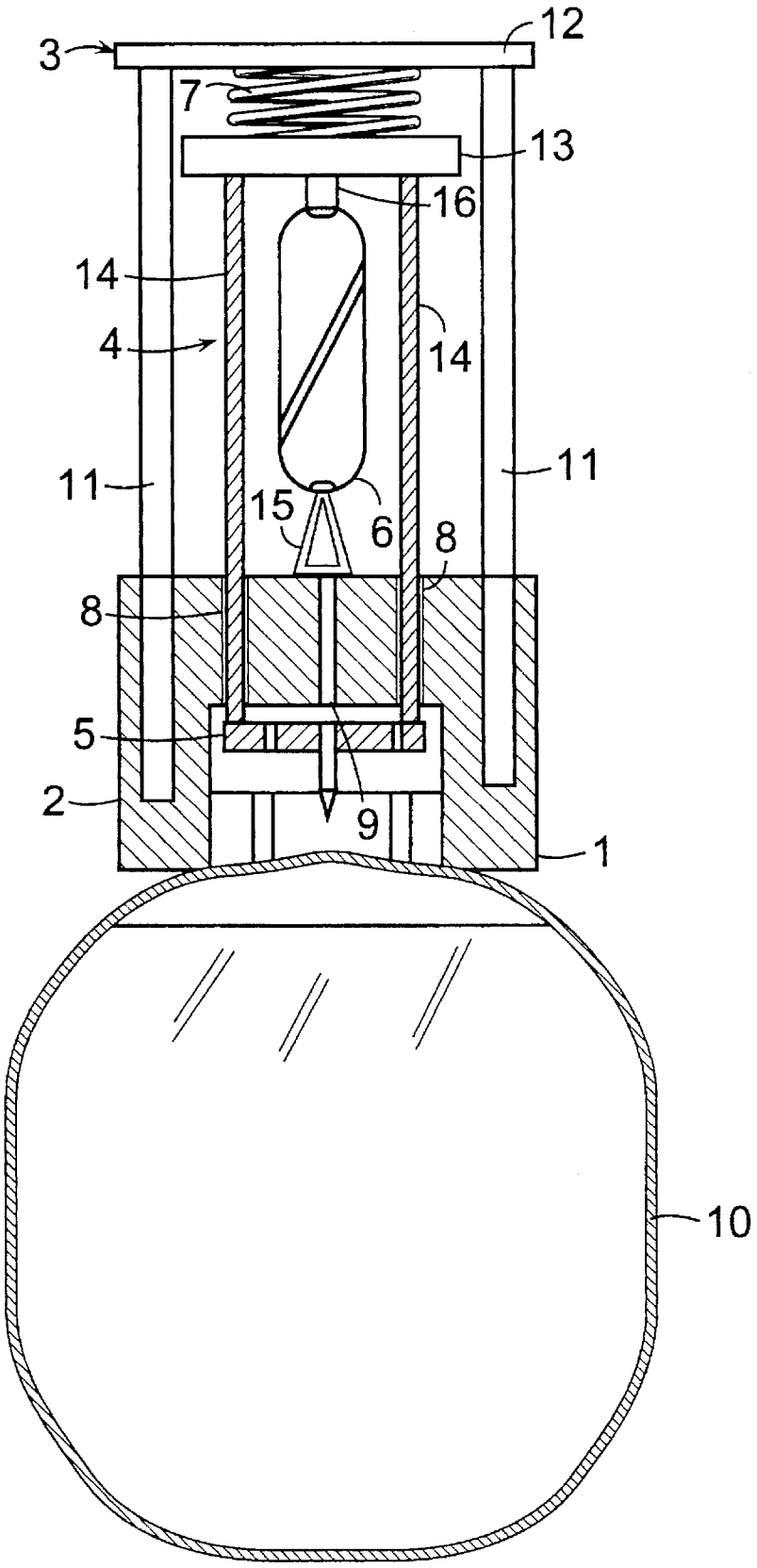
3
12
7
13
16
14
4
14
11
11
15
6
8
8
5
2
9
1
10

AUTOMATIC FIRE EXTINGUISHING DISCHARGE VALVE

BACKGROUND OF THE INVENTION

The present invention relates to a device for extinguishing fires. More particularly, it relates to a device that can be used on standard existing fire extinguisher tanks in order to more efficiently and safely extinguish fires using such tanks.

Discharge valves or devices for discharging the contents of a fire extinguisher are highly developed. For instance, in Willms, U.S. Pat. No. 3,860,073, a discharge valve is disclosed which is used on conventional fire extinguisher tanks to discharge the contents of the tanks. Willms device operates on the principle that pressure differentials acting upon the respective top and bottom of a valve permit the opening or closing of said valve. If the pressure on one side of the valve exceeds the pressure on the other side, (for instance the pressure on the bottom of the valve exceeds the pressure on the top of the valve) the valve will open, likewise if the pressure differential is reversed, (the pressure on the top of the valve exceeds the pressure on the bottom of the valve) the valve will close. However, devices such as that disclosed within this patent require manual operation to alter the pressure on either side of the valve, thereby enabling discharge of the contents of the fire extinguisher.

Devices have also been disclosed that involve the discharge of fire extinguisher tanks through use of inflatable devices that rupture upon impact between automobiles. Amir, U.S. Pat. No. 3,708,194 discloses such a device. Additionally, Kramer, et al, U.S. Pat. No. 3,788,666 discloses another device that involves the discharge of fire extinguishing fluid upon activation of an impact switch connected to a fire extinguisher.

Furthermore, there have been devices invented that trigger the discharge of fire extinguisher tanks through the use of heat sensors within a fire extinguishing device that actuates the fire extinguisher upon exposure to heat. Blanchong, U.S. Pat. No. 5,040,610 discloses such a device.

SUMMARY OF THE INVENTION

The present invention relates to a fire extinguishing device which provides automatic actuation upon exposure to a sufficient impact or sufficient heat. The device comprises a main body further including a puncturing element, a carriage assembly, a temperature sensitive trigger means, and means to maintain the trigger means and puncturing device in a ready position capable, upon satisfaction of the proper conditions, of activating the fire extinguishing device.

The present invention can be used in moving vehicles, such as cars, buses, boats, planes and trains, after mounting in specific locations within such vehicles so that the device and the anticipated discharge is aimed at potential fire hazards such as the engine or gas tank of such a vehicle. The present invention is a separate and independent mechanical device that does not require batteries, electricity or power of any manner in order for actuation. It is designed to extinguish fires and, in some cases, to prevent fires by automatically discharging a fire suppressant (for Class A, B, C, or D fires) on conditions of impact, fire, or both.

Another object of the present invention is to provide a device that triggers a fire extinguisher upon impact whereby the force of impact needed to discharge the fire suppressant can be adjusted according to the situation.

Still another object of the present invention is to provide a device in which the fire extinguisher is activated by fire in that a heat sensitive mechanical device triggers a fire suppressant at some predetermined temperature.

The uniqueness of the present invention is in its ability to be mounted on any type of fire extinguisher in any potential fire hazard area such as buildings, homes, computer areas, power stations, and vehicles.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

The FIGURE is a sectional view taken through the longitudinal centerline of the invention including a depiction of an attached fire extinguishing tank.

DETAILED DESCRIPTION OF THE PREFERRED EMBODIMENT

With reference to the FIGURE, a device for extinguishing fires is indicated generally at 1. The device 1 includes a main body 2 normally containing female threads so that the main body 2 can be screwed onto the top of a conventional fire extinguisher tank 10. Guide housing 3 is securely affixed to the upper surface of main body 2 by attachment of a single end of each of two parallel spaced beam elements 11. The two beam elements 11 form an integral part of the guide housing 3 and as such are securely affixed to an end cap 12 at the end opposite their attachment to main body 2. Carriage assembly 4 consists of a plate 13 having two parallel spaced beam elements 14 affixed in perpendicular relationship to one face of the plate. The opposite ends of the two beam elements of carriage assembly 4 extend completely and slidingly through two receiving holes machined longitudinally through main body 2. Puncturing element 5 is affixed to both ends of each of the two beam elements of carriage assembly 4, thereby completing carriage assembly 4. Puncturing element 5 remains retracted and concealed within a machined aperture located on the underside of main body 2. A discharge hole 9 is machined into main body 2 between the two receiving holes 8. Puncturing element 5 is designed so that once it is extended from the machined aperture it will pierce the seal of a fire extinguisher, thereby activating the fire extinguisher.

Placed between a finger 15 protruding axially outward from the centerline of the uppermost surface of main body 2 and a corresponding finger 16 protruding axially outward from the centerline of the lowermost surface of the plate 13, is trigger mechanism 6. Trigger mechanism 6 is a metal slug containing a temperature sensitive seam, where in the event the ambient temperature exceeds some predetermined design temperature, the temperature sensitive seam will fail thereby causing the metal slug to shear in two. Spring 7 is placed between the upper surface of the plate 13, and the lower surface of end cap 12. Spring 7 exerts a driving force onto carriage assembly 4 which transfers through the parallel spaced beam elements 14 of carriage assembly 4 to puncturing element 5. Trigger mechanism 6 holds this spring force in check, thereby preventing this spring force from thrusting puncturing element 5 into the seal of the fire extinguisher.

In addition besides trigger mechanism 6 failing in shear due to the melting of the temperature sensitive seam, trigger mechanism 6 can also be dislodged from its position by a predetermined inertial force to the device or the vehicle containing the device. By properly designing both the contact area between the ends of trigger mechanism 6 and the fingers; and the mass of trigger mechanism 6, a predetermined level of force would be necessary to dislodge trigger mechanism 6 from its seat.

While the invention has been described and illustrated with reference to a specific embodiment thereof, it is understood that other embodiments may be resorted to without departing from the invention. Therefore the form of the invention set out above should be considered illustrative and not as limiting the scope of the following claims.

We claim:

1. An automatic fire extinguishing discharge valve comprising:

a main body adapted to be attached to an outlet of a fire extinguisher, said main body having a hollow recess adapted to cover said outlet and having a first protruding finger on a surface opposite said hollow recess, said main body having at least two passages capable of each slidingly receiving a beam element and having at least one discharge hole capable of allowing passage of a fire extinguishing medium;

a guide housing having an end cap and at least two fixed beam elements securely affixed at a first end thereof to said end cap and at a second end thereof to the main body, said fixed beam elements are affixed at said first and second end such that they maintain parallel relation with respect to each other;

a carriage assembly having a plate, a puncturing means, and at least two sliding beam elements having first and second ends, said sliding beam elements are securely affixed at said first end to said plate and at said second end to said puncturing means, said sliding beam elements slidingly engage the passages of said main body and are affixed at said first and second end such that they maintain parallel relation with respect to each other and said passages, said plate having a second protruding finger, said second protruding finger pointing toward and in substantial axial alignment with said first protruding finger, said puncturing memos normally retracted and maintained within the hollow recess of said main body capable upon extension of puncturing a fire extinguisher seal;

a spring placed between said plate and said end cap, said spring constantly exerting sufficient force capable of driving said puncturing means through said fire extinguisher seal;

a trigger mechanism placed between said first and second protruding fingers, said trigger mechanism capable of continuous opposition to the force exerted by said spring so long as said trigger mechanism remains between said first and second protruding fingers.

2. An automatic fire extinguishing discharge valve as claimed in claim 1 wherein the trigger mechanism further includes a temperature sensitive seam, said temperature sensitive seam capable of allowing said trigger mechanism to fail in shear upon sensing a predetermined temperature, thereby removing opposition to said spring force.

3. An automatic fire extinguishing discharge valve as claimed in claim 2 wherein the mass of the trigger mechanism is selected so that a predetermined impact will jar said trigger mechanism from its seat between said first and second protruding fingers, thereby removing opposition to said spring force.

* * * * *